United States Patent [19]

Lista et al.

[11] 4,115,16(

[45] Sep. 19, 197(

[54] COATED AMMONIUM PERCHLORATE

[75] Inventors: Edwin L. Lista, Roseville; Richard B. Hartupee, West Covina; Ralph K. Manfred, Carmichael; Paul L. O'Neil, Sacramento, all of Calif.

[73] Assignee: Aerojet-General Corporation, El Monte, Calif.

[21] Appl. No.: 3,548

[22] Filed: Jan. 12, 1970

[51] Int. Cl.[2] ..... C06B 45/34

[52] U.S. Cl. ..... 149/7; 149/19.2; 149/19.91; 149/42; 149/76

[58] Field of Search ..... 146/7; 149/76

[56] References Cited

U.S. PATENT DOCUMENTS

| | | | |
|---|---|---|---|
| 3,190,776 | 6/1965 | Ender | 149/7 X |
| 3,402,065 | 9/1968 | McDonald et al. | 149/7 X |
| 3,466,204 | 9/1969 | Gow | 149/7 X |
| 3,480,488 | 11/1969 | Rudy et al. | 149/ |

*Primary Examiner*—Leland A. Sebastian

*Attorney, Agent, or Firm*—Edward O. Ansell

[57] ABSTRACT

This patent describes a solid oxidizer for solid rocke propellants comprising small ammonium perchlorat particles containing thereon a coating agent which i applied during the process of grinding larger ammo nium perchlorate particles under an inert liquid me dium.

8 Claims, 1 Drawing Figure

EDWIN L. LISTA
RICHARD B. HARTUPEE
RALPH K. MANFRED
PAUL L. O'NEILL
*INVENTORS*

BY Finkelstein & Mueth

*ATTORNEY*

COATED AMMONIUM PERCHLORATE

BACKGROUND OF THE INVENTION

Ammonium perchlorate is a well known oxidizer for solid rocket propellants. One commonly employed technique for changing the burning rate of a solid rocket propellant is to change the particle size of the ammonium perchlorate oxidizer. In general, the burning rate increases as the average particle size of the oxidizer decreases. The comminution of ammonium perchlorate has been most commonly accomplished by various grinding techniques. More recently, the increased demand for very fast burning propellants has increased the search for a practical process of producing even finer ammonium perchlorate particles, that is, particles having an average particle diameter of less than 6 microns. Such a process to be practical must be capable of providing suitably large quantities of the very fine ammonium perchlorate on a reproducible basis. One problem which has plagued efforts to produce the very fine ammonium perchlorate particles has been the tendency of the finely divided material to regrow or agglomerate during the manufacturing process or in storage, forming a coarser or lumpy product which is unacceptable and does not achieve the desired increase in burning rate. The fundamental causes underlying re-growth or agglomeration have not been precisely established but it appears that the phenomenon occurs primarily due to deliquescence, recrystallization, electrical, or pressure effects. For this reason various coating techniques have been suggested to reduce the tendency of the finely divided ammonium perchlorate particles to undergo re-growth or agglomeration. For example, silicon-containing materials such as Cab-O-Sil, magnesium oxide, magnesium stearate, calcium phosphate, various fatty acid amine derivatives and certain dyes have been applied both before and after the grinding of the ammonium perchlorate to prevent re-growth and agglomeration. However, none of these techniques have been entirely successful in solving the problem in the present invention. It is believed for the first there has been provided a way of producing finely divided ammonium perchlorate oxidizer on a reproducible basis which does not undergo re-growth or agglomeration.

SUMMARY OF THE INVENTION

Briefly, the present invention comprises a solid oxidizer for solid rocket propellants comprising small ammonium perchlorate particles containing thereon a coating agent which is applied during the process of grinding larger ammonium perchlorate particles under an inert liquid medium. This invention further comprises the method of making a finely divided, non-agglomerating coated ammonium perchlorate oxidizer which comprises grinding coarser ammonium perchlorate under an inert liquid medium in the presence of an ammonium perchlorate coating agent.

The coating agent is generally, although not necessarily present on the ammonium perchlorate particles in an amount from about 0.1% to about 1.5% by weight of the particles.

It is an object of the present invention to provide a novel coated ammonium perchlorate oxidizer which does not tend to undergo re-growth or agglomeration.

Another object of the present invention is the provision of novel solid rocket propellants containing finely divided ammonium perchlorate.

Still another object of the present invention is the provision of a novel technique for the grinding of ammonium perchlorate in such a way that it does not undergo re-growth or agglomeration.

These and other objects and advantages of this invention will be apparent from the more detailed description which follows.

DESCRIPTION OF PREFERRED EMBODIMENTS

Figure 1:
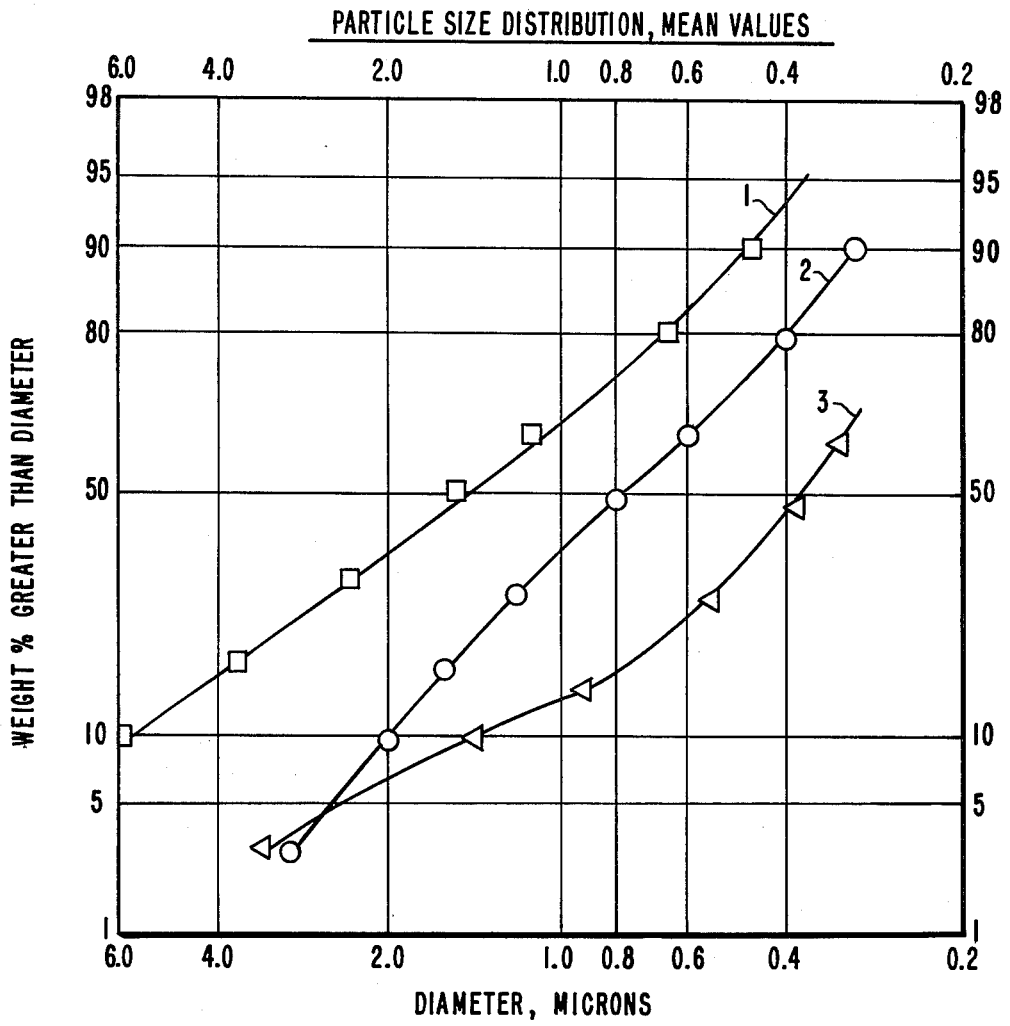

This invention is concerned with the application of a coating during a liquid grinding process which prevents re-growth or agglomeration during grinding permitting attainment of finer powders. While not bound by any theory, it is believed that in addition to providing a physical coating, the materials used in the grinding process of the present invention react chemically with ammonium perchlorate at the granule surface to increase the protection and provide a faster burning shell.

According to the present invention, coating is accomplished by adding the coating material to a liquid carrier in which the ammonium perchlorate is suspended during the grinding process. One of the principal advantages of the process of the present invention is that the fresh fracture surfaces are coated at once preventing re-growth. It appears that the inert liquid prevents moisture from the atmosphere to act on the fresh fracture surfaces and, thus, aids in the coating effect. If, as is speculated, a chemical reaction occurs between the exposed ammonium perchlorate crystal surfaces and the coating agent which is influential in preventing agglomeration or enhancing propellant burning rates, this coating process provides intimate and uniform contact with the prevention of localized excessive heat generation. In any event, it is clear that the process of the present invention provides for the uniformity even coating of the finely divided ammonium perchlorate.

The grinding of rocket fuel oxidizers is conducted in commercially available grinding equipment. The process consists of adding known quantities of the oxidizer to a fluid carrier and grinding for a specified time which is determined empirically with respect to the ingredients and final particle size required in the propellant formulation. The oxidizer is separated from the fluid and stored for later use as a rocket fuel ingredient. The following example is presented solely to illustrate the invention.

EXAMPLE

A small scale Vibro-Energy Mill-Model 185, manufactured by the Southwestern Engineering Company was used in this example. Ten pounds of unground ammonium perchlorate (180) was added to the Vibro-Energy Mill which contained 42 lbs. 12 oz. of FREON-113 (1, 1, 2 - trifluoro - 1, 2, 2-trichloroethane) and 200 lbs. of ½ inch × ½ inch alumina cylinder grinding media. 22-7 grams of butylene imine adduct of divinylbenzene in 150 ml methylene chloride was then added to the grinder and the mixture was ground for 24 hours at temperatures ranging from 70°–75° F. After the 24 hour grinding period the 50 lb. slurry of FREON-113, ammonium perchlorate and butylene imine adduct of divinylbenzene was drawn off into a suitable container and transported to a drying oven. The slurry was allowed to dry for five days at 140° F. to allow the FREON-113 to evaporate slowly from the slurry leaving a finely divided flowable solid mixture.

In FIG. 1, Curve 1 shows the particle size distribution of the finely ground ammonium perchlorate which has not been coated. Curve 2 shows the particle size distribution of the same ammonium perchlorate with 0.5% by weight of butylene imine adduct of divinylbenzene. In the case of the materials described by Curves 1 and 2, the grinding time was 24 hours. The material of Curve 3 was identical to that of Curve 2 in every respect except that the grinding time was increased to 96 hours. FIG. 1 shows that the coating provided by our invention gives an average particle size reduction from 180 for unground material to about 0.8. The particle sizes were measured in a Mine Safety Appliances particle size measuring apparatus which employs a liquid sedimentation technique.

As will be appreciated by those skilled in the art, the grinder used in the above example can be replaced by other commercial equipment, simply by determining the operating characteristics of the particular grinder. The preferred inert liquid medium is a halogenated hydrocarbon. However, any of the inert liquids are useful.

The coated ammonium perchlorate of this invention is mixed into the propellant using equipment and processes standard to the industry. Vertical mixers have been preferably used because they provide higher shear conditions which provide better dispersion of the fine oxidizer particles and de-agglomeration of fine particle agglomerates.

The following propellant was preferred:

PROPELLANT COMPOSITION

| Ingredients | |
|---|---|
| $NH_4ClO_4$ | |
| Slow-speed micro-pulverized ground ammonium perchlorate (130) | 35.0 |
| Ultra fine ammonium perchlorate (0.5) | 36.0 |
| Aluminum | 14.5 |
| n-Butylferrocene | 1.6 |
| Carboxy Terminated Polybutadiene and Tris (2-methylaziridinyl) phosphine oxide | 12.9 |

The carboxy terminated polybuladiene polymer, n-butylferrocene, aluminum powder, formulation and tris-1-(2-methyl) aziridinyl phosphine oxide (MAPO) were added to the mixer bowl at 100°–135° F. then the ultrafine ammonium perchlorate is added and incorporated, then the coarser ammonium perchlorate fraction was incorporated. The propellant was then mixed for 30 minutes to several hours and finally the butylene imine derivative of isosebacic acid (BISA) curative was added and incorporated the propellant was then cast. The invention, however is also however, is also applicable to other propellant systems including the polyurethanes and mix processes.

For comparative evaluation of composition variables the above propellant is mixed for a total of 35 minutes and then is cast into Crawford bomb strands which are tested uncured. The following data were obtained:

| Grind | Burning rate, ips at 2000 psia | Pressure Exponent |
|---|---|---|
| Uncoated UFAP (Control) | 3.7 | 0.45 |
| Coated with 0.5% Tris (2-methylaziridinyl) phosphine oxide | 4.2 | 0.44 |
| 0.1% Crystal Violet | 4.1 | 0.46 |

-continued

| Grind | Burning rate, ips at 2000 psia | Pressure Exponent |
|---|---|---|
| 0.5% ethylene imine adduct of divinylbenzene | 4.5 | 0.4 |
| 0.5% butylene imine adduct of divinylbenzene | 4.8 | 0.4 |

Longer mix cycles show that although the coating does not prevent all agglomeration, the data indicate that the presence of coating permits formation of smaller ammonium perchlorate particles and possibly gives more easily attrited agglomerates. In any case, the coated ultra-fine oxidizer permits attainment of higher burning rates.

The following are additional examples of our invention:

| Weight % Coating | Composition of Coating | Burning rate in./sec. at 2000 psi. | Particle Size, microns: 50% point initial | Particle Size, microns: 50% point 24 hrs. at 45% relative humidity |
|---|---|---|---|---|
| 0.5 | Butylene imine adduct of divinylbenzene | 4.8 | .53 | .53 |
| 0.5 | Propylene imine adduct of divinylbenzene | 4.4 | .83 | .97 |
| 0.5 | Ethylene imine adduct of divinylbenzene | 4.15 | .93 | |
| 0.5 | Tris(2-ethylaziridinyl) phosphine oxide | 4.40 | .83 | 1.12 |
| 0.5 | An epoxide from Union Carbide | 4.05 | 1.00 | 1.15 |
| 0.5 | Carboxy-terminated polybutadiene (Thiokol Chemical Corp.) | 3.85 | .91 | 3.9 |
| 0.5 | 2,2-bis(2-methyl-aziridinyl) diethyl sulfone | 4.15 | .90 | 1.12 |
| 0.5 | Butylene amine adduct of sebacic acid | 4.10 | .99 | 1.05 |
| 0.5 | Tris(2-ethylaziridinyl) Triazine | | .90 | |
| 1% | Tris(2-ethylaziridinyl) Triazine | | | 1.37 |
| 1% | Butylene amine adduct of sebacic acid | | | 2–3 |
| 1% | Butylene imine adduct of divinylbenzene | | 1.17 | 1.42 |
| 1% | 2,2-bis(2-methylaziridinyl) diethyl sulfone | | | 1.7 |
| 1% | Ethylene imine adduct of divinylbenzene | | | 1.8 |
| 1% | Propylene imine adduct of divinylbenzene | | | 1.55 |
| 1% | An epoxide from Union Carbide | | 1.22 | 3.5 |
| 1% | Tris(2-Phenylaziridinyl) Phosphine oxide | | 1.32 | 1.6 |
| 1% | Propylene imine adduct of hexamethylene diisocyanate | | | 1.78 |
| 1% | Propylene imine adduct of toluene diisocyanate | | 1.32 | 1.52 |

Safety data obtained with the coated products indicate that these products have properties not appreciably different from those of the uncoated control. The disclosed invention can be extended by optimizing the concentration or nature of the coating agent and is not to be restricted to the concentrations or kinds of coating agents mentioned.

Having fully described the invention it is intended that it be limited only by the lawful scope of the appended claims.

We claim:

1. The novel solid rocket propellant containing as the oxidizer ammonium perchlorate particles containing thereon a coating agent comprising an alkylene imine adduct of divinylbenzene selected from the group consisting of the ethylene, propylene or butylene adducts thereof.

2. The propellant of claim 1 wherein the coating agent is a butylene imine adduct of divinylbenzene.

3. The propellant of claim 1 wherein the coating agent is a propylene imine adduct of divinylbenzene.

4. The propellant of claim 1 wherein the coating agent is an ethylene amine adduct of divinylbenzene.

5. Coated ammonium perchlorate wherein the coating comprises an alkylene imine adduct of divinylbenzene selected from the group consisting of the ethylene, propylene or butylene adduct thereof.

6. The coated ammonium perchlorate of claim 5 wherein the alkylene moiety is butylene.

7. The coated ammonium perchlorate of claim 5 wherein the alkylene moiety is propylene.

8. The coated ammonium perchlorate of claim 5 wherein the alkylene moiety is ethylene.

* * * * *

UNITED STATES PATENT OFFICE

CERTIFICATE OF CORRECTION

PATENT NO. : 4,115,166

DATED : September 19, 1978

INVENTOR(S) : Edwin L. Lista et al

It is certified that error appears in the above-identified patent and that said Letters Patent are hereby corrected as shown below:

Column 2, line 54, change "(180)" to -- (180μ) --
Column 3, line 11, change "180" to -- 180μ --
Column 3, line 12, change "0.8" to -- 0.8μ --
Column 3, in the Propellant Composition table, 1st column, 5th line, change "(130)" to -- (∿130μ) --
Column 3, in the Propellant Composition table, 1st column, 7th line, change "(0.5)" to -- (0.5μ) --

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*